US006647744B2

(12) United States Patent
Fanning et al.

(10) Patent No.: US 6,647,744 B2
(45) Date of Patent: Nov. 18, 2003

(54) PROCESSES AND SYSTEMS FOR LIQUEFYING NATURAL GAS

(75) Inventors: Robert A. Fanning, Highland Village, TX (US); Keenis E. Davis, Houston, TX (US); James E. Kaucher, Katy, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 10/352,441

(22) Filed: Jan. 28, 2003

(65) Prior Publication Data

US 2003/0159462 A1 Aug. 28, 2003

Related U.S. Application Data

(60) Provisional application No. 60/353,323, filed on Jan. 30, 2002.

(51) Int. Cl.[7] ..... F25J 3/00
(52) U.S. Cl. ..... 62/612
(58) Field of Search ..... 62/611, 612, 613

(56) References Cited

U.S. PATENT DOCUMENTS 4,680,041 A * 7/1987 DeLong ..... 62/612
4,970,867 A 11/1990 Herron et al. ..... 62/11
5,768,912 A * 6/1998 Dubar ..... 62/613
6,016,665 A 1/2000 Cole et al. ..... 62/612
2002/0170312 A1 * 11/2002 Reijnen et al. ..... 62/611

FOREIGN PATENT DOCUMENTS

WO WO 97/33131 12/1997

OTHER PUBLICATIONS

A. Avidan, et al., "Large LNG Plants—Optimizing Train Size", Phillips Petroleum Company Website (www.phillips66.com), Jun. 2, 2002, pp. 1–10.

* cited by examiner

*Primary Examiner*—William C. Doerrler
(74) *Attorney, Agent, or Firm*—Marcy Hoefling

(57) ABSTRACT

Natural gas liquefaction systems are provided wherein the dedicated compression strings normally found in each liquefaction train of a multi-train LNG plant are replaced by common compression strings which, in turn, supply the respective refrigerants (e.g. propane and mixed refrigerant) to more than one of the multi-trains. This allows the refrigerants to be treated as a utility in that all of the refrigerants are supplied from a respective single source by the common compression strings.

12 Claims, 2 Drawing Sheets

PROCESSES AND SYSTEMS FOR LIQUEFYING NATURAL GAS

This application claims the benefit of U.S. Provisional Application No. 60/353,323, filed Jan. 30, 2002.

FIELD OF THE INVENTION

The present invention relates to processes and systems for liquefying natural gas. In one aspect the invention relates to such processes and systems wherein common compression string(s) are used to compress and recycle the refrigerants used in a plurality of individual trains which, in turn, are used for liquefying natural gas.

BACKGROUND OF THE INVENTION

Various terms are defined in the following specification. For convenience, a Glossary of terms is provided herein, immediately preceding the claims.

Large volumes of natural gas (i.e. primarily methane) are located in remote areas of the world. This gas has significant value if it can be economically transported to market. Where the gas reserves are located in reasonable proximity to a market and the terrain between the two locations permits, the gas is typically produced and then transported to market through submerged and/or land-based pipelines. However, when gas is produced in locations where laying a pipeline is infeasible or economically prohibitive, other techniques must be used for getting this gas to market.

A commonly used technique for non-pipeline transport of gas involves liquefying the gas at or near the production site and then transporting the liquefied natural gas to market in specially-designed storage tanks aboard transport vessels. The natural gas is cooled and condensed to a liquid state to produce liquefied natural gas at substantially atmospheric pressure and at temperatures of about −162° C. (−260° F.) ("LNG"), thereby significantly increasing the amount of gas which can be stored in a particular storage tank. Once an LNG transport vessel reaches its destination, the LNG is typically off-loaded into other storage tanks from which the LNG can then be revaporized as needed and transported as a gas to end users through pipelines or the like.

As will be understood by those skilled in the art, plants used to liquefy natural gas are typically built in stages as the supply of feed gas, i.e. natural gas, and the quantity of gas contracted for sale, increase. Each stage normally consists of a separate, stand-alone unit, commonly called a train, which, in turn, is comprised of all of the individual components necessary to liquefy a stream of feed gas into LNG and send it on to storage. As used hereinafter, the term "stand-alone train" means a unit comprised of all of the individual components necessary to liquefy a stream of feed gas into LNG and send it on to storage. As the supply of feed gas to the plant exceeds the capacity of one stand-alone train, additional stand-alone trains are installed in the plant, as needed, to handle increasing LNG production.

In typical LNG plants, each stand-alone train includes at least a cryogenic heat exchange system for cooling the gas to a cryogenic temperature, a separator (i.e. a "flash tank"), a "reject gas" heat exchanger, and a fuel gas compressor. As used herein, a "cryogenic temperature" includes any temperature of about −40° C. (−40° F.) and lower. LNG is typically stored at substantially atmospheric pressure and at temperatures of about −162° C. (−260° F.). To reduce the pressure of feed gas during liquefaction, it is typically passed from the cryogenic heat exchange system across an expansion valve or hydraulic turbine in a stand-alone train (i.e. "flashed") before it is passed into the separator (i.e. the flash tank). As the pressure of the cooled feed gas is reduced to produce LNG, some of the gas flashes and becomes vapor. LNG is removed from the flash tank and is pumped from its respective stand-alone train on to a storage tank for further handling.

In somewhat greater detail, each stand-alone train is comprised of a cryogenic heat exchange system which, in turn, utilizes two or more refrigerant circuits, acting in series, to cool the feed gas down to the cryogenic temperature needed for liquefaction. Typically, the first circuit carries a first refrigerant (e.g. propane) which is compressed by a first compression string in the stand-alone train and is circulated through a series of primary heat exchangers to heat exchange with and initially cool the feed gas. Typically, the second refrigerant circuit carries a second refrigerant, e.g., a mixed refrigerant "MR" (e.g. nitrogen, methane, ethane, and propane) which is compressed by a second compression string in the stand-alone train and is circulated first through a series of propane heat exchangers and then through a main cryogenic heat exchanger to thereby complete the cooling of the feed gas to produce the LNG. In some cases, the cryogenic heat exchange system utilizes a cascade refrigeration system, a dual mixed refrigerant system, or some other refrigeration system, as will be familiar to those skilled in the art.

In some cases, the economics of an LNG plant may be improved by driving the compressors in both the first and second compression strings through one or more common shafts. However, this does not overcome all of the disadvantages associated with each stand-alone train in an LNG plant requiring its own dedicated, compression strings. For example, a complete stand-alone train, including two or more compression strings, must be installed in a plant each time it becomes desirable to expand the LNG plant production capacity, which can add significantly to the capital and operating costs of the plant. Further, if any refrigerant compressor, or its driver (e.g., a gas turbine) fails, in a particular stand-alone train, the affected stand-alone train must be shut down until the failed compressor and/or driver can be repaired. LNG production at the plant is significantly reduced during the down time. Still further, anytime a stand-alone train is shut down due to failure of a compression string, the temperature in the main cryogenic heat exchanger of that stand-alone train will rise substantially thereby requiring "recooling" of the main heat exchanger to the cryogenic temperature before the train can be put back into production.

It is desirable to improve processes and systems for liquefying natural gas to lower the costs of LNG production as much as possible so that LNG can continue to be delivered to market at a competitive price.

SUMMARY OF THE INVENTION

The present invention provides natural gas liquefaction systems and processes wherein a first refrigerant and a second refrigerant are treated as a utility, and are supplied from a common source to a plurality of dependent trains in an LNG plant. This allows the dedicated, compression strings, which are normally found in each stand-alone train of a multi-train LNG plant, to be replaced by common compression strings which, in turn, supply the refrigerants to more than one dependent train in the plant. As used hereinafter, the term "dependent train" includes any unit in an LNG plant that lacks its own, dedicated compression string.

More specifically, the present invention relates to an LNG system that is comprised of two or more dependent trains, each of which converts a feed gas into LNG. Each dependent train includes at least a first refrigerant circuit and a second refrigerant circuit, in series, which cool the feed gas to the cryogenic temperature needed for LNG. The first refrigerant (e.g. propane) flows through a series of primary heat exchangers in the first refrigerant circuit to initially cool the feed gas. A second refrigerant (e.g. mixed refrigerant comprised of nitrogen, methane, ethane, and propane) flows through a cryogenic heat exchange system, comprised of one or more individual heat exchangers, in the second refrigerant circuit to further cool the gas and convert it into LNG. This invention is applicable to other types of cryogenic heat exchange systems, including without limitation those with cascade refrigeration systems that use two or more refrigeration systems, those with a dual mixed refrigerant system, or those with some other refrigeration system, as will be familiar to those skilled in the art. For example, without limiting the scope of this invention, this invention is applicable to cascade refrigeration systems with three refrigeration loops in which the refrigeration from one stage is used to condense the compressed refrigerant in the next stage.

In dependent trains of the present invention, dedicated compression strings for circulating desired refrigerants through their respective circuits are not required. Instead, a set of common compression strings are provided in the present system to supply refrigerants from a common source to more than one of the dependent trains in the LNG plant.

If more than one set of common compression strings are required due to the increasing size of an LNG plant (i.e. number of dependent trains to be serviced), a plurality of first compression strings are provided and manifolded together so that compressed first refrigerant from the first compression strings can be directed to various dependent trains as needed. Likewise, a plurality of second compression strings can be manifolded together whereby the second refrigerant from the second compression strings can be directed to various dependent trains as needed.

It will be recognized that by treating all of the refrigerants in an LNG plant as a utility (i.e. a single first refrigerant supply, a single second refrigerant supply, etc.) and by using independent, common compression strings to supply the refrigerants to the respective refrigerant circuits in a plurality of dependent trains, a significant number of benefits will be realized.

DESCRIPTION OF THE DRAWINGS

The advantages of the present invention will be better understood by referring to the following detailed description and the attached drawings in which.

While the invention will be described in connection with its preferred embodiments, it will be understood that the invention is not limited thereto. On the contrary, the invention is intended to cover all alternatives, modifications, and equivalents which may be included within the spirit and scope of the present disclosure, as defined by the appended claims.

DETAILED DESCRIPTION OF THE INVENTION

Figure 1:
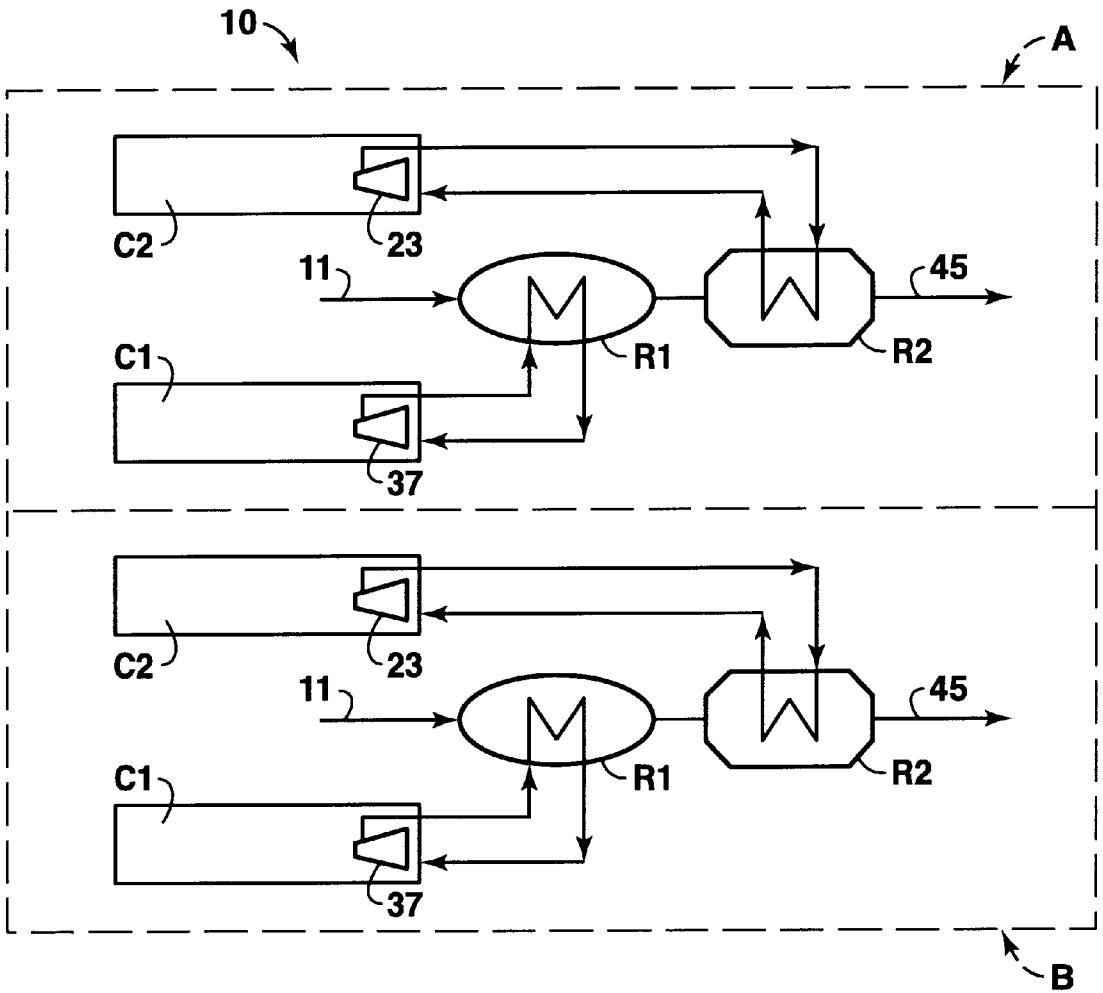
FIG. 1 (PRIOR ART)
FIG. 1 (PRIOR ART) is a simplified flow diagram of a typical system for liquefying natural gas.

Referring more particularly to the drawings, FIG. 1 (Prior Art) schematically illustrates a system and process for liquefying natural gas in a typical LNG plant 10. As shown, plant 10 is comprised of a plurality of stand-alone trains A and B (only two shown) which are basically identical and independent of each other. As will be understood in the art, a typical LNG plant 10 is built in stages (i.e. trains) so that a second train B is installed when feed gas production capacity exceeds that required for the existing train(s), sufficient new LNG sales contracts have been procured to justify construction of an additional train, and so forth, as will be familiar to those skilled in the art.

Basically, feed gas enters a respective stand-alone train through an inlet line 11 and flows through one or more primary heat exchangers in a first refrigerant circuit R1 where the feed gas is initially cooled by heat exchange with a first refrigerant, e.g., propane. The first refrigerant is circulated through the first refrigerant circuit R1 by a first dedicated compression string C1, which includes compressor(s) 37 driven by gas turbines or the like (not shown). The cooled feed gas then passes through a cryogenic heat exchange system, comprised of one or more individual heat exchangers, in second refrigerant circuit R2 where it is cooled to a cryogenic temperature of LNG, typically about −162° C. (−260° F.) by heat exchange with a second refrigerant, e.g., a mixed refrigerant "MR" (e.g. nitrogen, methane, ethane, and propane). The second refrigerant is circulated through the second refrigerant circuit by a second dedicated compression string C2, which includes compressor(s) 23 driven by gas turbines or the like (not shown). Once the pressure of the thus cooled feed gas is reduced to about atmospheric pressure, e.g., by being passed through an expansion valve or hydraulic turbine (not shown), and a flash tank (not shown) to separate LNG from unliquefied gas, produced LNG exits stand-alone trains A and B through outlet 45. Since the details of operation of a typical stand-alone train A or B in an LNG plant 10 are well known to those skilled in the art, a detailed description is not provided.

Figure 2:
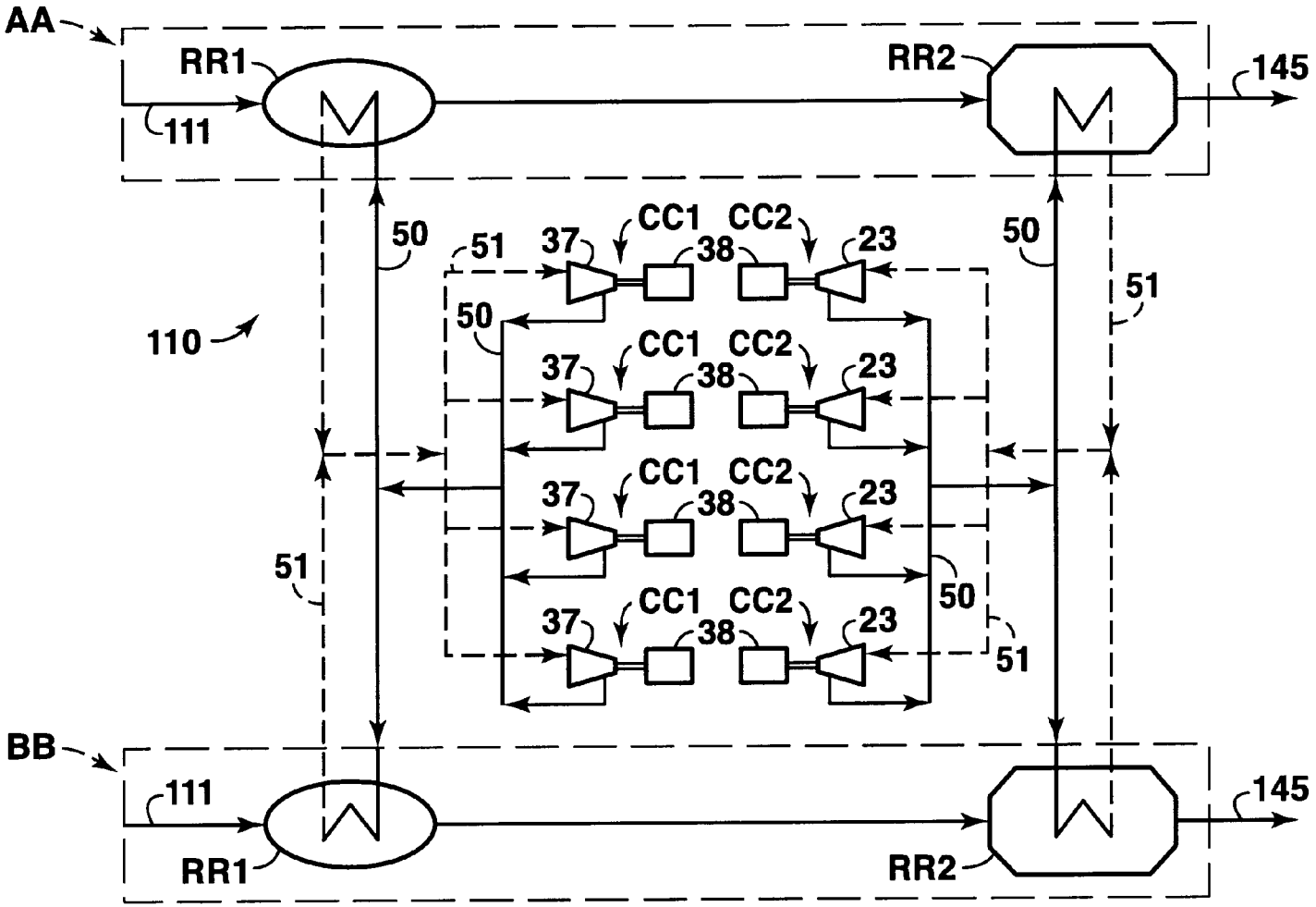
FIG. 2 is a simplified flow diagram of a system for liquefying natural gas in accordance with the present invention.

Referring now to FIG. 2, the natural gas liquefying system and process of the present invention is schematically illustrated. Basically, the system illustrated is comprised of a plurality of separate dependent trains (only two shown, AA and BB) located in LNG plant 110. Trains AA and BB differ from typical LNG trains A and B of FIG. 1 in that each of trains AA and BB do not include compression components, rather each consists essentially of a first refrigerant circuit RR1 and a second refrigerant circuit RR2 which, in turn, consist essentially of heat exchange components for reducing the temperature of a feed gas to about −162° C. (−260° F.), which heat exchange components are well known to those skilled in the art. A dependent train may comprise two or more refrigerant circuits.

In the present invention, feed gas (i.e. natural gas) enters a respective train through inlet line 111 and flows through a series of primary heat exchangers (not shown in FIG. 2) in first refrigerant circuit RR1. Any suitable primary heat exchanger arrangement may be utilized in first refrigerant circuit RR1, as will be familiar to those skilled in the art. In this embodiment, a first refrigerant is circulated through these primary heat exchangers to initially cool the feed gas in the same manner as described above. For example, without limiting this invention, propane may be used as the first refrigerant. The cooled feed gas continues on through the second refrigerant circuit RR2 where it passes through a cryogenic heat exchange system, comprised of one or more individual heat exchangers. Any suitable primary heat exchanger arrangement may be utilized in second refrigerant circuit RR2, as will be familiar to those skilled in the art. The feed gas is cooled in the cryogenic heat exchange system, comprised of one or more individual heat exchangers, by a second refrigerant to cool the feed gas to a cryogenic temperature of about −162° C. (−260° F.). For example, without limiting this invention, mixed refrigerant "MR" (e.g. nitrogen, methane, ethane, and propane), may be used as the second refrigerant. Once the pressure of the thus cooled feed gas is reduced to about atmospheric pressure, e.g., by being passed through an expansion valve or hydraulic turbine (not shown), produced LNG exits dependent trains AA and BB through outlet(s) 145.

In this embodiment, the first compression string CC1 is located at a common point within plant 110 where it can compress and circulate the first refrigerant, e.g. propane, through the respective first refrigerant circuits RR1 of a plurality of trains such as AA and BB in FIG. 2. First compression string CC1 includes compressor(s) 37 driven by suitable drivers 38, such as gas and/or steam turbines, and/or electric motors, and/or the like, as will be familiar to those skilled in the art. Likewise, the second compression string CC2 is located at a common point within plant 110 where it can compress and circulate the second refrigerant, e.g. MR, through the respective second refrigerant circuits RR2 of a plurality of trains such as AA and BB. Second compression string CC2 includes compressor(s) 23 driven by suitable drivers 38, such as gas and/or steam turbines, and/or electric motors, and/or the like, as will be familiar to those skilled in the art. In certain embodiments of this invention, one or more of the trains may include one or more dedicated compression strings as needed. It is not required that every train in the system be served by common compression strings; i.e., a plant 110 may also include some independent trains.

First compression string CC1 may be comprised of a single compressor or it may be comprised of one or more single or multi-stage compressors, as will be familiar to those skilled in the art. Likewise, second compression string CC2 may be comprised of a single compressor or it may be comprised of one or more single or multi-stage compressors. A set comprised of a first compressor and a second compressor may be driven by a common shaft or may be driven by individual prime movers, e.g. gas turbines, as the case may dictate and as is familiar to those skilled in the art.

A single set of first and second compressors may be adequate to circulate the respective refrigerants through the refrigerant circuits of all of the trains. If more that one set of common compressors are needed, it can be seen in FIG. 2 that a plurality of first compression strings CC1 (four shown) are connected together by a manifold system so that the first refrigerant can be directed from any of these first compression strings CC1 through the first refrigerant circuit of any or all of the plurality of trains (e.g. either or both trains AA and BB in FIG. 2) by selective manipulation of the appropriate valves (not shown) in the supply and return lines 50, 51.

The same is true of a plurality of second compression strings CC2 which are connected together by a second manifold system which allows any of the second compression strings to circulate a second refrigerant through one or more of the second refrigerant circuits in any of the trains in plant 110. As seen in FIG. 2, the output from the respective compressors strings flow through the supply lines (e.g., solid lines 50) and the return flows back to the respective compression strings through the return lines (e.g., dotted lines 51).

By treating the refrigerants in the plant 110 as a utility (i.e. a single first refrigerant supply and a single second refrigerant supply) and by using independent, common compression strings to supply these respective refrigerants to the refrigerant circuits in a plurality of trains, a significant number of benefits is realized, some of which are as follows: (1) Significantly less equipment is needed, thereby reducing the capital costs of the LNG plant; (2) A single spare compression string can be installed to back up any of the other common compression strings being used to supply refrigerant to the different trains in the LNG plant; (3) If one compression string fails while circulating a refrigerant to a particular train, the affected train can be immediately switched to a back-up compression string without substantially halting LNG production through that train; and (4) By switching to a back-up second compression string, the cryogenic heat exchange system, comprised of one or more individual heat exchangers, can be kept cold during repair of the compressor(s) which had been supplying MR to the heat exchange system in the affected train.

While the present invention has been described in terms of one or more preferred embodiments, it is to be understood that other modifications may be made without departing from the scope of the invention, which is set forth in the claims below. For example, refrigerants other than the ones specified herein may be utilized, etc.

GLOSSARY OF TERMS cryogenic temperature: any temperature of about −40° C. (−40° F.) and lower;

dependent train: any unit in an LNG plant that lacks its own, dedicated compression string;

flash tank: a gas/liquid separator;

LNG: liquefied natural gas at substantially atmospheric pressure and at temperatures of about −162° C. (−260° F.);

stand-alone train: a unit in an LNG plant comprised of all of the individual components necessary to liquefy a stream of feed gas into LNG and send it on to storage.

We claim:

1. A natural gas liquefaction system comprising:

(A) two or more dependent trains, each of said dependent trains comprising:
  (i) an inlet for a feed gas;
  (ii) a first refrigerant circuit for initially cooling said feed gas; and
  (iii) a second refrigerant circuit for cooling said initially-cooled feed gas to a cryogenic temperature;

(B) at least one common first compression string for circulating a first refrigerant through said first refrigerant circuit of each of said dependent trains;

(C) at least one common second compression string for circulating a second refrigerant through said second refrigerant circuit of each of said dependent trains; and (D) means for reducing the pressure of said cryogenic temperature feed gas to substantially atmospheric pressure to produce liquefied natural gas.

2. The natural gas liquefaction system of claim 1 wherein said first refrigerant is propane or a mixed refrigerant comprising at least one refrigerant selected from the group consisting of (i) nitrogen, (ii) methane, (iii) ethane, and (iv) propane, and said second refrigerant is a mixed refrigerant comprising at least one refrigerant selected from the group consisting of (i) nitrogen, (ii) methane, (iii) ethane, (iv) ethylene, and (v) propane.

3. The natural gas liquefaction system of claim 1 wherein said first refrigerant is propane or a mixed refrigerant comprising at least one refrigerant selected from the group consisting of (i) nitrogen, (ii) methane, (iii) ethane, and (iv) propane, and said second refrigerant is an essentially pure component refrigerant selected from the group consisting of (i) nitrogen, (ii) methane, (iii) ethane, (iv) ethylene, and (v) propane.

4. The natural gas liquefaction system of claim 1 wherein said at least one common first compression string comprises two or more individual compression strings and a manifold system for connecting each of said individual compression strings whereby each of said individual compression strings is adapted to circulate said first refrigerant to any of said first refrigerant circuits in said dependent trains.

5. The natural gas liquefaction system of claim 1 wherein said at least one common second compression string comprises two or more individual compression strings and a manifold system for connecting each of said individual compression strings whereby each of said individual compression strings is adapted to circulate said second refrigerant to any of said second refrigerant circuits in said dependent trains.

6. The natural gas liquefaction system of claim 1 wherein said first compression string comprises at least one first compressor, said second compression string comprises at least one second compressor, and said at least one first compressor and said at least one second compressor are driven by a common shaft.

7. A process for liquefying natural gas, said process comprising flowing said feed gas through at least one of said dependent trains to initially cool said feed gas by heat exchanging said feed gas with a first refrigerant and to further cool said feed gas to a cryogenic temperature by heat exchanging said initially-cooled feed gas with a second refrigerant, including supplying said first refrigerant to said dependent trains from a common first compression string and supplying said second refrigerant to said dependent trains from a common second compression string.

8. The process of claim 7 wherein said first refrigerant is propane or a mixed refrigerant comprising at least one refrigerant selected from the group consisting of (i) nitrogen, (ii) methane, (iii) ethane, and (iv) propane, and said second refrigerant is a mixed refrigerant comprising at least one refrigerant selected from the group consisting of (i) nitrogen, (ii) methane, (iii) ethane, (iv) ethylene, and (v) propane.

9. The process of claim 7 wherein said first refrigerant is propane or a mixed refrigerant comprising at least one refrigerant selected from the group consisting of (i) nitrogen, (ii) methane, (iii) ethane, and (iv) propane, and said second refrigerant is an essentially pure component refrigerant selected from the group consisting of (i) nitrogen, (ii) methane, (iii) ethane, (iv) ethylene, and (v) propane.

10. The process of claim 7 wherein said first common compression string comprises at least one first compressor and wherein said second common compression string comprises at least one second compressor and wherein said process includes:

driving said at least one first compressor and said at least one second compressor through a common shaft.

11. The process of claim 7 wherein said first refrigerant is supplied to said dependent trains by a plurality of said common first compression strings which are fluidly connected whereby any of said plurality of common first-compression strings can supply said first refrigerant to any of said dependent trains.

12. The process of claim 7 wherein said second refrigerant is supplied to said dependent trains by a plurality of said common second compression strings which are fluidly connected whereby any of said plurality of common second compression strings can supply said second refrigerant to any of said dependent trains.

* * * * *

UNITED STATES PATENT AND TRADEMARK OFFICE

CERTIFICATE OF CORRECTION

PATENT NO. : 6,647,744 B2
DATED : November 18, 2003
INVENTOR(S) : Fanning et al.

It is certified that error appears in the above-identified patent and that said Letters Patent is hereby corrected as shown below:

Column 7,
Line 29, after "flowing" delete "said".
Line 29, after "of" delete "said".
Line 29, after "of" insert -- a plurality of --.

Signed and Sealed this

Seventh Day of February, 2006

JON W. DUDAS
*Director of the United States Patent and Trademark Office*